US011469056B2

(12) United States Patent
Bossoni et al.

(10) Patent No.: US 11,469,056 B2
(45) Date of Patent: Oct. 11, 2022

(54) GRIPPING GROUP OF CALIPER-LIKE ELEMENTS FOR GRIPPING MOVEABLE CONTACTS

(71) Applicant: MICROELETTRICA SCIENTIFICA S.P.A, Buccinasco (IT)

(72) Inventors: Carlo Bossoni, Milan (IT); Davide Faioni, Milan (IT)

(73) Assignee: MICROELETTRICA SCIENTIFICA S.P.A.

( * ) Notice: Subject to any disclaimer, the term of this patent is extended or adjusted under 35 U.S.C. 154(b) by 0 days.

(21) Appl. No.: 17/277,262

(22) PCT Filed: Aug. 27, 2019

(86) PCT No.: PCT/EP2019/072796
§ 371 (c)(1),
(2) Date: Mar. 17, 2021

(87) PCT Pub. No.: WO2020/057907
PCT Pub. Date: Mar. 26, 2020

(65) Prior Publication Data

US 2022/0037093 A1 Feb. 3, 2022

(30) Foreign Application Priority Data

Sep. 17, 2018 (EP) ..... 18194804

(51) Int. Cl.
*H01H 1/14* (2006.01)

(52) U.S. Cl.
CPC ..... *H01H 1/14* (2013.01)

(58) Field of Classification Search
CPC ..... H01H 1/14; H01H 1/42; H01H 2001/425
See application file for complete search history.

(56) References Cited

U.S. PATENT DOCUMENTS

| | | | | |
|---|---|---|---|---|
| 1,978,246 | A | 10/1934 | Bauerschmidt | |
| 3,427,419 | A | 2/1969 | Findley, Jr. | |
| 8,987,618 | B2 * | 3/2015 | Thompson | H01H 11/00 200/50.17 |
| 2013/0319831 | A1 | 12/2013 | Thompson | |

FOREIGN PATENT DOCUMENTS

| | | | |
|---|---|---|---|
| DE | 1092988 | B | 11/1960 |

OTHER PUBLICATIONS

International Search Report and Written Opinion corresponding to PCT/EP2019/072796 dated Oct. 23, 2019.

* cited by examiner

*Primary Examiner* — Vanessa Girardi
(74) *Attorney, Agent, or Firm* — Barnes & Thornburg LLP

(57) ABSTRACT

The present invention relates to a gripping group for a switch, changeover switch, disconnector or generally a power switch, said power switch being mounted inside an insulated switch body and comprising at least a movable contact providing an electrical connection, said gripping group being configured to grip said at least a movable contact of said power switch, wherein a modular structure comprising a plurality of caliper-like elements being parallelly mounted on a supporting frame and in turn including respective terminal finger elements being angularly movable one with respect to the other, mutually approaching and moving away in contrast with elastic returning means.

12 Claims, 4 Drawing Sheets

GRIPPING GROUP OF CALIPER-LIKE ELEMENTS FOR GRIPPING MOVEABLE CONTACTS

CROSS REFERENCE AND PRIORITY CLAIM

This patent application is a U.S. National Phase of International Patent Application No. PCT/EP2019/072796 filed Aug. 27, 2019, which claims priority to European Patent Application No. 18194804.3, the disclosure of which being incorporated herein by reference in their entireties.

FIELD

Disclosed embodiments relate to a gripping group for a switch, for instance a changeover switch, with an improved internal structural and functional configuration and a more compact structure as a whole.

More specifically, but not exclusively, disclosed embodiments relate to a gripping group for a power switch suitable for industrial application with high current involved, especially in the railways field.

BACKGROUND

As it is well known in this specific technical filed, a switch is an electrical component that can "make" or "break" an electrical connection within a circuit, interrupting a current or diverting it from one conductor to another. The switch removes or restores a conducting path in the circuit when it is operated.

A particular type of switch is a so-called disconnector. A disconnector is used to ensure that an electrical circuit is completely de-energized for service or maintenance, nevertheless, during normal operation a disconnector must be able to support both the normal current flow as well as the short circuit current defined for the specific application without any consequential damage. Such disconnectors are often found in electrical distribution and industrial applications, where machinery must have its source of driving power removed during adjustment or repair operations. High-voltage isolation switches are in particular used in electrical sub-stations to ensure the isolation of apparatuses such as circuit breakers, transformers, and transmission lines, in particular during their maintenance. A disconnector is usually not intended for providing a normal control of an electrical circuit, but only for ensure safety isolation and thus the management of the same. Disconnectors can be operated either manually or automatically.

SUMMARY

Disclosed embodiments provide an internal locking mechanism for the internal movable contacts of a switch ensuring a compact configuration of the same, in particular in the case of a changeover switch.

Disclosed embodiments provide a switch with an internal locking mechanism that guarantee a more efficient operation of the switch as a whole.

Additionally, disclosed embodiments provide a switch with an internal configuration that guarantees a higher reliability and a long operating life.

Further, disclosed embodiments provide a switch internal configuration that does not require complex manufacturing steps and thus high manufacturing costs.

Further, disclosed embodiments provide a switch internal configuration easy to be applicable on different types of power switches.

Thus, disclosed embodiments use gripping groups of caliper-like elements to grip the movable contacts of a switch, thereby providing a locking mechanism with a compact configuration, a strong locking force and also applicable with different movable contact shapes.

BRIEF DESCRIPTION OF FIGURES

Further features and advantages of the switch of the present invention will appear from the following description given by way of not limiting example with reference to the enclosed drawings figures.

DETAILED DESCRIPTION

Figure 1:
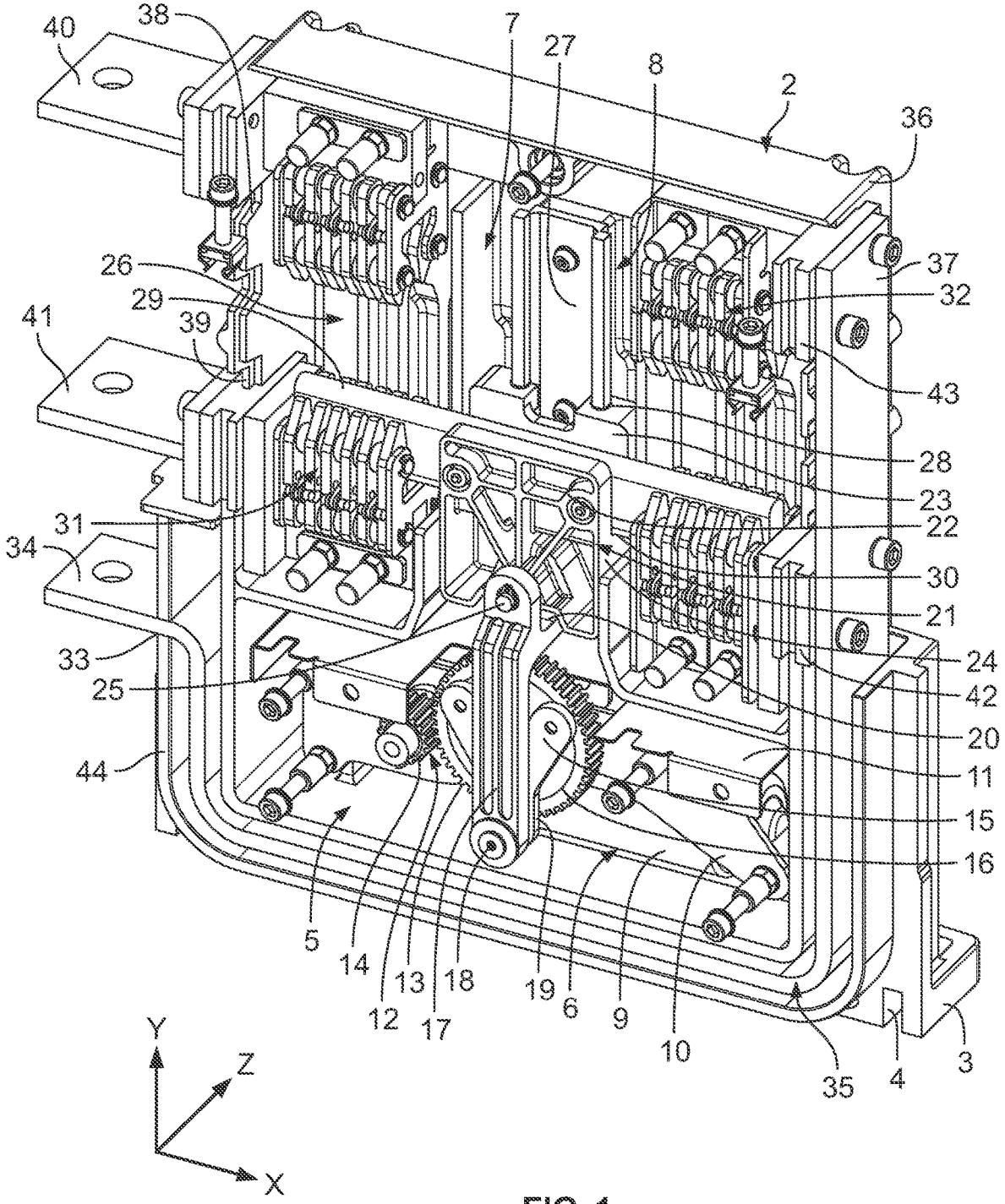
FIG. 1 shows a perspective view of a switch comprising a gripping group realized according to the disclosed embodiments.
Figure 2:
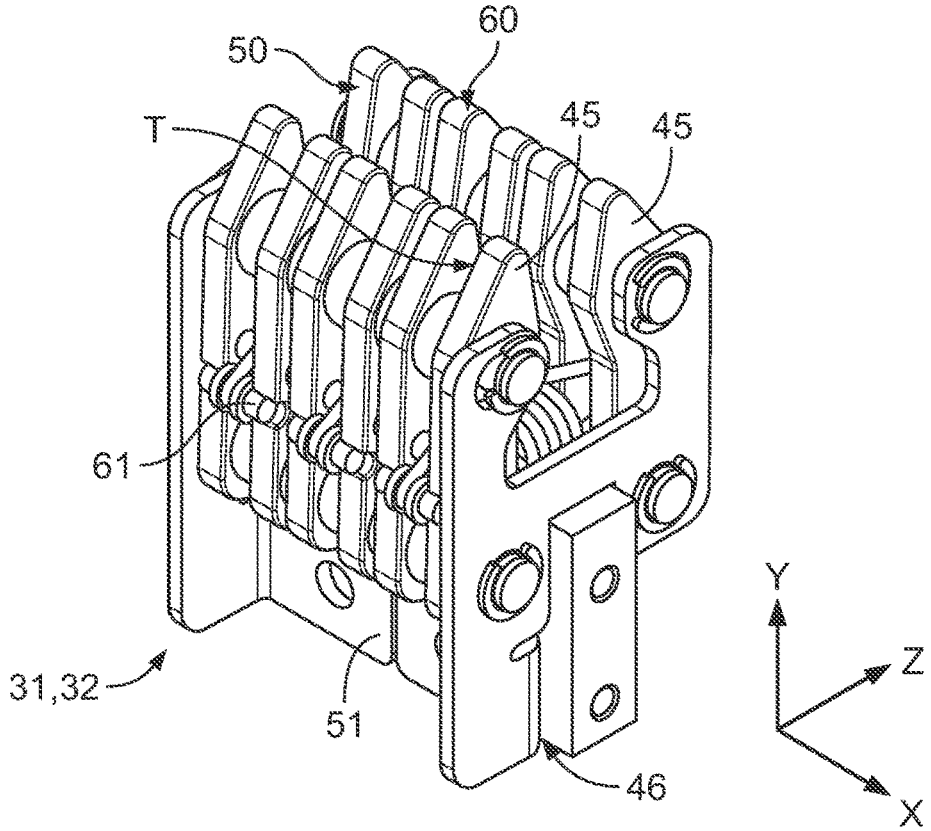
FIG. 2 shows a perspective view of a gripping group according to the disclosed embodiments.
Figure 3:
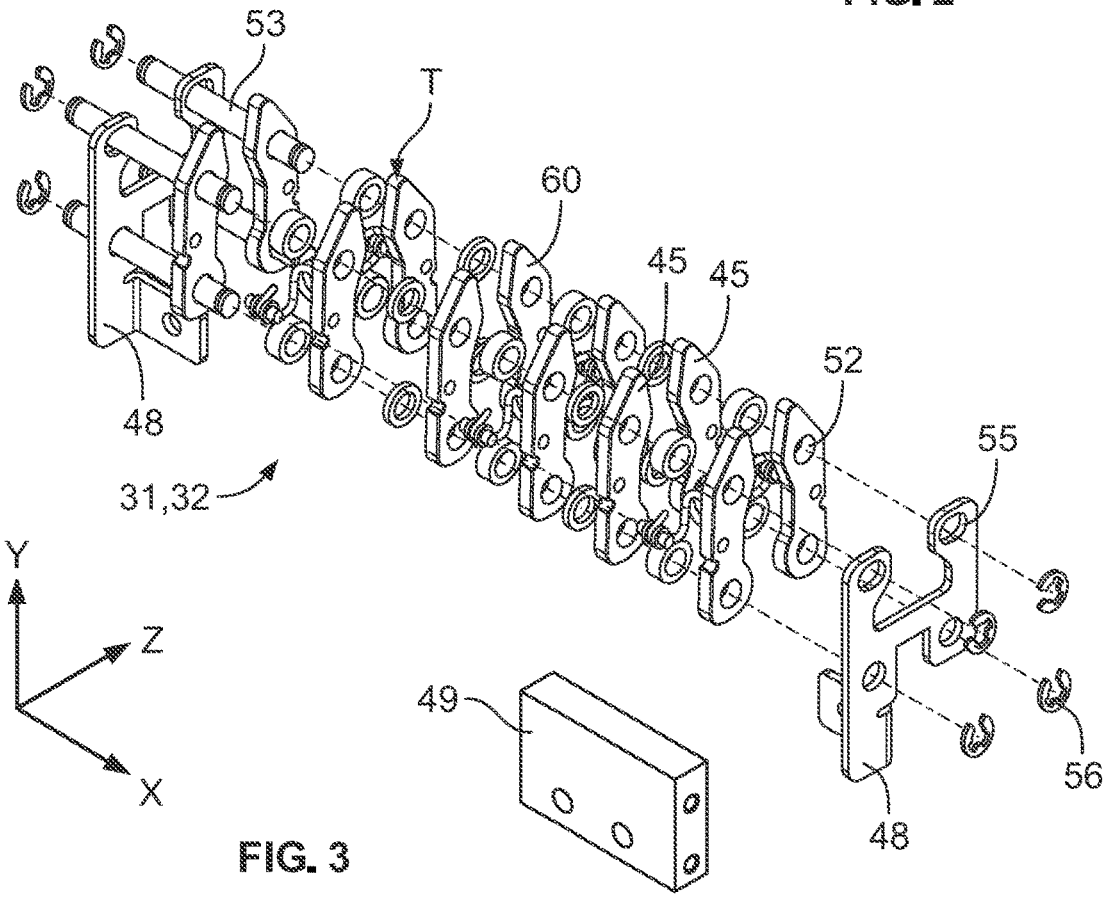
FIG. 3 shows an exploded view of the gripping group of FIG. 2.
Figure 4:
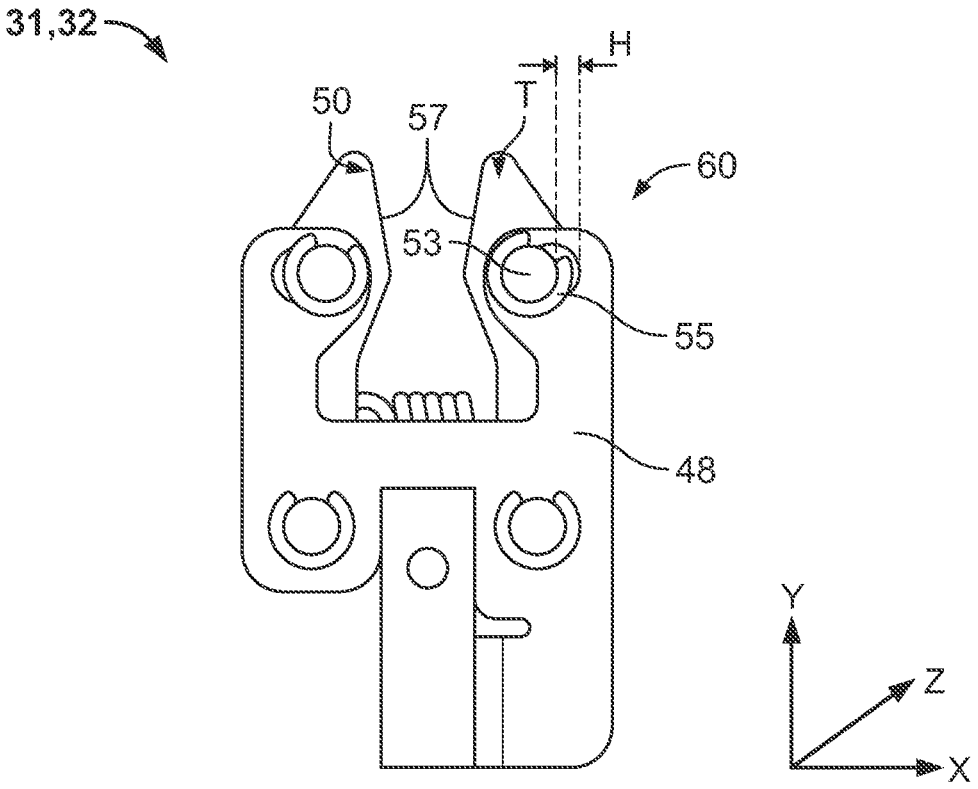
FIG. 4 shows a front view of a caliper-like element of the gripping group of FIG. 2.
Figure 5:
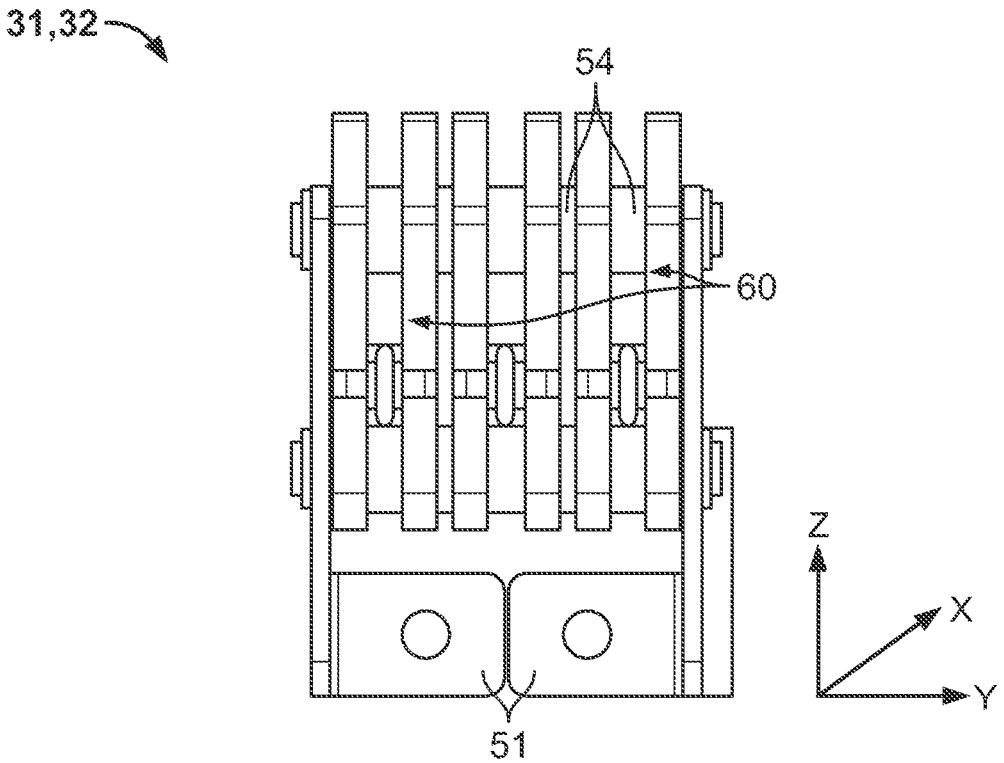
FIG. 5 shows a lateral view of the gripping group of FIG. 2.
Figure 6:
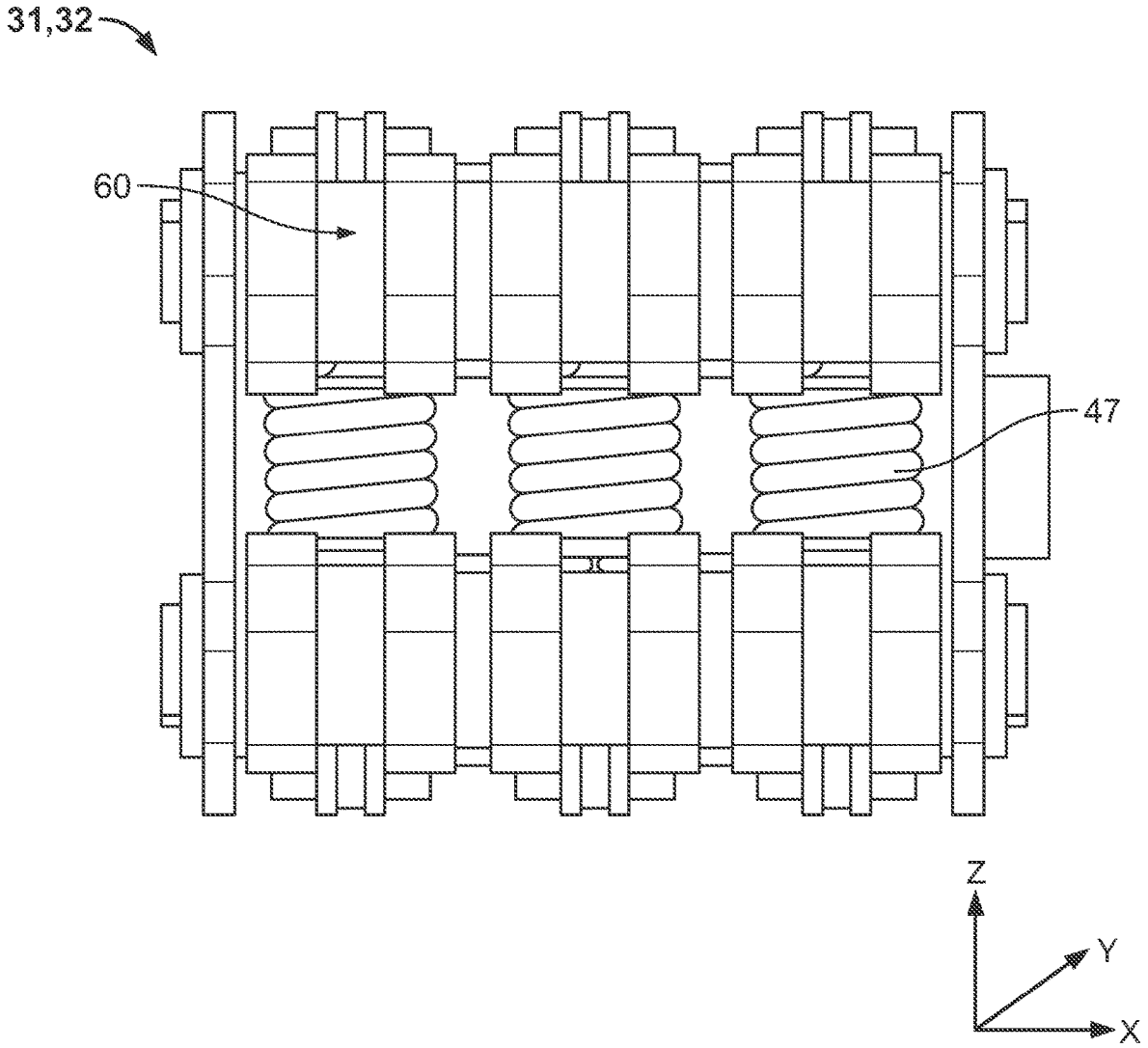
FIG. 6 shows a top view of the gripping group of FIG. 2.

Unlike load switches and circuit breakers, disconnectors lack a mechanism for suppressing electric arcs, which usually occurs when conductors carrying high currents are electrically interrupted. Thus, they can be considered as off-load devices, intended to be opened only after a current flowing within the conductors connected thereto has been already interrupted by using another control device.

In some circuit breakers of the known type, when a contact is interrupted, it is also possible to establish a connection with a different electrical circuit using another contact.

That is the case of the so-called "changeover contacts" or "changeover switch", wherein precisely a set of three electrical contacts is provided, thereby allowing that a contact to one circuit is interrupted and then established with another circuit.

A set of three contacts is usually referred to as a pole. A changeover switch can have one or more poles. The contacts in a pole are made of materials, which are hard and resistant to burnout and corrosion, for instance suitably treated copper and related alloys.

Even if they are useful, the changeover switches are generally rather big and cannot be often employed, especially in those applications wherein it is necessary an optimization of space to organize as many electrical circuits as possible in a limited area.

In view of this, space-safe internal moving mechanisms have been developed, for example, in order to move movable contacts of a changeover switch.

Despite of the undoubted advantages provided by this moving mechanism, the position of the movable contacts within the changeover switch could be not certainly fixed, because also a little vibration of the switch itself could physically move one of such movable contacts and interrupt the electric connection provided by the switch under undesired conditions.

On the other side, known locking mechanisms to be used to fix the positions of the movable contacts would newly introduce the problem tied to obtaining a compact configuration of the switch and, in some cases, would even not guarantee the sure locking of the movable contact positions, and consequently a sure electrical connection provided by the switch.

Movable contacts and internal locking mechanism are also used in other type of switches, for instance disconnectors, in particular for industrial or railways application, or in general power switches.

So, the technical problem of the disclosed embodiments is that of providing an internal locking mechanism for the internal movable contacts of a switch ensuring a compact configuration of the same, in particular in the case of a changeover switch.

Disclosed embodiments provide a switch with an internal locking mechanism that guarantee a more efficient operation of the switch as a whole.

Disclosed embodiments provide a switch with an internal configuration that guarantees a higher reliability and a long operating life.

Disclosed embodiments provide a switch internal configuration that does not require complex manufacturing steps and thus high manufacturing costs.

Disclosed embodiments provide a switch internal configuration easy to be applicable on different types of power switches.

The technical solution at the basis of the disclosed embodiments is that of using gripping groups of caliper-like elements to grip the movable contacts of a switch, thus providing a locking mechanism with a compact configuration, a strong locking force and also applicable with different movable contact shapes. Such gripping groups of caliper-like elements are widely used in the mentioned field, so that the specificity of the invention is related to a new shape design of caliper that reduce the total dimension of the group, and of the switch as a whole.

According to the technical solution, the technical problem is solved by a gripping group for a switch, changeover switch, disconnector and generally a power switch, in particular for industrial or railways application, the power switch being mounted inside an insulated body and comprising at least a movable contact providing an electrical connection, the gripping group being configured to grip at least the movable contact of the power switch. The gripping group has a modular structure comprising a plurality of caliper-like elements being parallelly mounted on a supporting frame and in turn including respective terminal finger elements being angularly movable one with respect to the other mutually approaching and moving away in contrast with elastic returning mechanism.

Advantageously, this structure shape of the gripping group allows a very compact overall structure of the switch comprising them, guaranteeing at the same time an efficient operation in term of mechanical stability and correct electrical connection.

Moreover, advantageously the modular configuration is an optimized design for different sizes of the switches.

Optionally, each caliper-like element of the gripping group is formed by two terminal finger elements and is independently movable relative to other caliper-like elements of a same gripping group. Moreover, the terminal finger elements of a caliper-like element are movable independently from the terminal finger elements of the other caliper-like elements of a same gripping group.

Advantageously, this independent movement allows to the gripping group to be applicable with different movable contact shapes, acting like a hand when gripping the movable contact.

According to a particular aspect of the disclosed embodiments, each terminal finger element of the caliper-like elements includes at least two holes in proximity of two opposite ends thereof.

Optionally, the gripping group according to the disclosed embodiments include a pin for each hole of the terminal finger elements of the caliper-like elements.

This structure guarantee to maintain a packed configuration of the gripping group, and so to guarantee a space-safe overall structure of the group.

Moreover, the supporting frame of the gripping group according to a particular aspect includes at least two supporting elements, located at the ends of the gripping group, to secure a packed configuration.

Optionally, the supporting elements comprise an eyelet for the pins in correspondence of each holes of the terminal finger elements, at least two eyelet providing a clearance relative to such pins.

Advantageously, thanks to this particular configuration, it is possible a correct movement of caliper-like elements of each gripping group.

Furthermore, the supporting frame of a gripping group according to a still particular aspect of the disclosed embodiments further includes an interconnecting beam, on which the supporting elements are mounted.

Advantageously, this configuration is structurally easy to manufacture and reliable in operation.

According to another aspect of the disclosed embodiments, the gripping group further including a bush in correspondence of each hole of the terminal finger elements and between the caliper-like elements of the gripping group.

Moreover, the elastic returning mechanism, optionally in the form of a spring, is alternately located between the caliper-like elements of the gripping group.

This particular aspect allows a correct and independent movement of each caliper-like elements of each gripping group.

According to a particular aspect of the invention, the gripping group further includes a locking washer for each pin, located on the eyelets of the supporting element, on the other side relative to the caliper-like elements, in order to guarantee the maintaining of the packed configuration of the caliper-like elements of the group.

According to a further aspect of the invention, the terminal finger elements of each caliper-like element have a rounded pointed tip at one end in correspondence of a gripping portion of the corresponding caliper-like element.

Moreover, optionally, facing profiles of the terminal finger elements of each caliper-like element creates a converging-diverging space.

This particular shape of the terminal finger elements facilitates the gripping phase, allowing at the same time a correct gripping of the movable contact.

Finally, it must be noted that a gripping group is suitable for any power switch, whatever can be the current level as a different, increased or decreased, number of calipers like elements can be installed in order to comply with the requested current rate.

It is clear that the possibility of applicate the same components on different models of switches is a remarkable advantage in terms of production time and cost evaluation.

With reference to the drawings figures, with 1 is globally and schematically indicated a switch, in particular a changeover switch, realized according to the disclosed embodiments.

The illustrative switch 1 is specifically provided for industrial or railway applications wherein a high D.C. current must be disconnected or switched on and off for heavy frequencies switching actions.

The switch 1 includes an insulated switch body 2 in turn including all the moving portions of the switch itself, that will be disclosed hereinafter.

In the specific embodiment shown in FIG. 1, a changeover switch is specifically disclosed, but the same working mechanism can be applied in a disconnector or generically in a power switch.

In the described exemplary embodiment of FIG. 1 the switch body 2 has substantially a parallelepipedal shape with a depth much lower than the other two dimensions.

Moreover, in particular, FIG. 1 shows a switch 1 with a front surface removed in order to show all the elements contained in the switch body 2.

The switch body 2 includes a base 3, suitable for connection by a couple of notches 4 within an electrical system, or simply as a support for the switch 1.

The switch 1 is internally divisible in two main portions, a lower portion 5 in proximity of the base 3, wherein a moving mechanism 6 is housed, and a higher portion 7, which stands above the lower portion 5, wherein an electrical connection group 8 is housed. These space references are referred to an installation of the switch extended in a vertical position, in particular according to an Y axis of the local reference system indicated in the figures.

The moving mechanism 6 includes motorized mechanism 9. The motorized mechanism 9, such as an electromagnetic coil. However, nothing refrains from use other motorized mechanism 9, such as an electric motor. The moving mechanism 6 is optionally a rotative kinematic mechanism.

The motorized mechanism 9 are covered by a vertical bulkhead 10 and a horizontal bulkhead 11, to protect the motorized mechanism 9 and to divide the lower portion 5 and the higher portion 7.

The motorized mechanism 9 is also operatively connected to a gear system 12 comprising a main gear 13 and a secondary gear 14.

A shaft 15 is connected on a plane surface 16 of the main gear 13. In the exemplary embodiment represented in FIG. 1, the shaft 15 has a three lobes shape, but nothing refrains from use, for example a straight shaft 15.

A rod 17 is connected on its end 18 to one lobe 19 of the shaft 15. In this way, the rotation of the main gear 13 causes the rotation of the shaft 15 and consequently a translational movement of the rod 17.

In other words, the shaft 13 and the rod 17 act as a piston rod/crankshaft mechanism.

The rod 17 also provides a connection between the lower portion 5 and the higher portion 7.

On its opposite end 20, the rod 17 has a U-shaped section in a direction of a depth of the switch body 2, i.e. the opposite end 20 is U-shaped along the Z axis of the local reference system shown in the figures.

The cavity of the U-shaped opposite end 20 is complementary with a support sliding element 21.

The support sliding element 21 includes a front plate 22 and a rear plate 23, parallelly disposed, transversally connected by a connecting portion 24 on the direction of the depth of the switch body 2, about at mean size of the front plate 22 and rear plate 23. In other words, the support sliding element 21 is H-shaped in the direction of the depth of the switch body 2.

The front plate 22 has a rectangular section with a recess 25 on the lower side facing the rod 17. The recess 25 is inserted in the cavity of the U-shaped opposite end 20 of the rod 17, and optionally fixed by a transversal pin.

The rear plate 23 is on a rear surface 26 of the switch body 2.

Preferably, a guide 27 is interposed between the rear plate 23 and the rear surface 26, along a central axis of the switch body 2. In the described embodiment, the guide 27 has an omega-profile and the rear plate 23 has a corresponding and complementary shape with grooves 28 to slide on the omega-shaped guide 27.

Nothing refrains to use other type of guides 27 over which the support sliding element 21 can slide.

A movable contact 29 is placed on an upper side 30 of the connecting portion 24, and it is fixed, for example, by screws or bolts. The movable contact 29 is a plate rod or bar extended transversely with respect to the guide 27.

In this way, the sliding of the support sliding element 21 causes the translational movement of the movable contact 29.

An opening 33 is provided on a lateral side 44 of the switch body 2.

A terminal contact 34 projects through such opening 33.

The terminal contact 34 is associated to a contact bar 35, which runs peripheric from the opening 33 on the lateral side 44 to an upper end 36 of the opposite side 37 of the switch body 2.

Two other openings 38 and 39 are provided parallel to the opening 33 at the two extremity positions of the movable contact 29.

In the embodiment shown in FIG. 1, two corresponding terminal contacts 40 and 41 project from the openings 38 and 39. In a disconnector, only a terminal contact 40 projecting from an opening 38 would be provided. Obviously, the terminal contact 34 is always present.

Two corresponding connecting elements 42 and 43 are provided at the opposite side 37 of the openings 38 and 39, in contact with the contact bar 35. When the movable contact 29 is at its respective extremity positions, the connecting elements 42, 43 allow to connect the contact bar 35 with the movable contact 29 and to the corresponding terminal contacts 40, 41, respectively.

In other words, two alternative connection configurations are provided between the terminal contact 34 and the terminal contacts 40, 41, respectively, depending on the position of the movable contact 29 along the contact bar 35.

In case of a disconnector, only one connecting element 42 would be provided.

Another feature of the switch 1 is the presence of an electronic board (not shown) associated to rear side of the switch 1 outside the switch body 2.

This electronic board is in particular provided to regulate the electric supply to the motorized mechanism 9. More specifically, according the present exemplary but not limitative embodiment, the electronic board is structured to supply the correct voltage and current values to the coil for predetermined scheduled times.

These correct voltage and current values are supplied independently from the possible excursions of the main voltage supply and in a range of operating temperatures variable between −40° C. and +75° C.

The high reliability operating conditions of the electronic board are guaranteed by the presence of heat dissipating elements and circuit recovery mechanism mounted on the electronic board.

Moreover, the electronic board is provided with a proper level of immunity against radiated and conducted disturbances according to the more severe railways requirements.

A further specific insulation of at least 1500 V (at 50 Hz and for 60s) toward ground is provided, for the whole the low voltage equipment of the device.

Suitably, at the lower position of the support sliding contact 21 and of the movable contact 29, at least a gripping group 31 is provided, able to ensure both the electrical connection and the locking action. Preferably, a couple of gripping groups 31 are provided at the opposite ends of the plate bar movable contact 29. These gripping groups 31 are upwardly oriented having respective gripping portions extending up to the plate bar movable contact 29 from below.

Conversely, at the upper position of the support sliding contact 21 and of the movable contact 29, at least an opposite gripping group 32 can be provided. Preferably, a couple of gripping groups 32 are provided at the opposite ends of the plate bar movable contact 29, when a double disconnection, or a changeover is required.

The gripping groups 32 have respective gripping portions facing the gripping portions of the gripping groups 31, so being downwardly oriented.

It is underlined that a configuration comprising two calipers groups 31 and two opposite gripping groups 32 for each movable contact 29 position is possible, because this configuration guarantees better structural balancing.

In a disconnector switch, only two terminal contacts are provided, so it is possible to use only one couple of gripping groups 31, but nothing refrains to use another couple of gripping groups also for a disconnecting position, allowing continuity in a different circuit when the continuity in the former circuit is interrupted.

The gripping group 31 and the opposite gripping group 32, as shown particularly in FIGS. 2 to 5, comprise suitable miniaturized caliper-like elements 60, adapted for releasably locking in position the movable contact 29 in two extremity position, respectively. As it will be clarified in the following, these gripping groups 31, 32, thanks to the miniaturized caliper-like elements 60, act as a hand on the movable contact 29.

More particularly, the gripping groups 31, 32 comprise a plurality of caliper-like elements 60, modularly mounted in parallel on a common supporting frame 46. Each caliper-like element 60 in turn includes a couple of terminal finger elements 45, angularly movable with respect one another, mutually approaching and moving away in contrast with elastic returning mechanism 47. The elastic returning mechanism 47 can be in the form of springs connected to the terminal finger elements 45. Such a working mechanism allows the gripping groups 31, 32 comprising the caliper-like elements 60 to act as a hand, the terminal finger elements 45 ensuring a gripping force with the movable contact 29 and allowing a correct establishment of the electrical connection.

In particular, advantageously according to the invention, the terminal finger elements 45 of a caliper-like element 60 are movable independently from the terminal finger elements 45 of the other caliper-like elements 60 of the same gripping group 31, 32.

Moreover, each caliper-like element 60 is independently movable relative to other caliper-like elements 60 of the gripping groups 31, 32.

The supporting frame 46 includes at least two supporting elements 48 located at the ends of the gripping group 31 or 32, to secure a packed configuration. In this way, the caliper-like elements 60 of the gripping groups 31, 32 are suitably comprised and securely packed between the supporting elements 48 of the supporting frame 46.

The supporting frame 46 further includes an interconnecting beam 49 on which the supporting elements 48 are mounted. The interconnecting beam 49 is located at an end of the terminal finger elements 45, opposite to a gripping portion 50 of the caliper-like elements 60, substantially forming a base thereof.

In particular, the interconnecting beam 49 is disposed transversally relative to the gripping direction of the gripping group 31, 32.

The two specular supporting elements 48 are H-shaped with one leg longer than the other, and parallel to the caliper-like elements 60 of the gripping group 31, 32. On the longer leg of the supporting element 48 a protruding plate portion 51 in the direction of the interconnecting beam 49 and connected adherent to the interconnecting beam 49. The protruding plate 51 is thus connected to the interconnecting beam 49 through a bolt, a screw, or similar device.

Each terminal finger element 45 includes at least two holes 52 in proximity of its two opposite ends. Each hole 52 houses a pin 53, suitable to fasten in a "packed configuration" the gripping group 31, 32.

A bush 54 is provided at each hole 52 in the terminal finger elements 45 between the caliper-like elements 60 of the respective gripping group 31, 32.

Moreover, in the disclosed embodiments described herein, the elastic returning mechanism 47 include springs which are alternately disposed between the caliper-like elements 60 of the gripping group 31, 32.

These springs 47 are perpendicularly disposed relative to the terminal finger elements 45 and are maintained in position through pegs 61 on the ends of the springs 47, the pegs 61 being fitted in correspondent traces 54 on an external surface of the terminal finger elements 45.

Preferably, the bushes 54 are thicker inside the combined couple of caliper-like elements 60 where also the springs 47 are present, and thinner outside the couple of caliper elements, where springs 47 are not present.

This shrewdness allows to minimize the dimension of the overall gripping group, but it is clearly also possible to adopt bushes 54 having same size, for example for simplifying the production of the gripping groups as a whole.

The supporting elements 48 comprise an eyelet 55 for each pin 53 in correspondence of each hole 52 of the terminal finger elements 45. The eyelets 55 at the gripping portion 50 provide a clearance H relative to the pins 53, in order to allow the opening movement of the gripping group 31, 32.

Moreover, a locking washer 56 is provided for each pin 53, located on the eyelets 55 on the other side with respect to the caliper-like elements 60. In this way, an undesired extraction of the pin 53 from its seat is avoided.

In the exemplary embodiment described herein, the terminal finger elements 45 also have a rounded pointed tip T at the respective gripping portion 50.

Moreover, in the present embodiment, facing profiles 57 of the terminal finger elements 45 create a converging-diverging space between the terminal finger elements 45 themselves.

This particular conformation of the gripping group 31, 32 allows both a rapid coupling between the caliper-like elements 60 and the movable contact 29 and a stable position of the movable contact 29 also in case of vibration in order to ensure electrical connection and disconnection only in operative conditions.

The gripping groups 31, 32 can be implemented in any power switch, in particular for industrial or railways application.

It will be described below the operation of the gripping group 31, 32 according to the present invention.

The actuation of the motorized mechanism 9 put in rotation the gear system 12. The rotation of the gear system 12 causes a translational move of the rod 17, whose one end is connected to one end of the shaft 15. The translational movement of the rod 17 thus causes a pull or push action on the support sliding element 21, and consequently on the movable contact 29.

At the extremity positions of the support sliding element 21 and of the movable contact 29 at least one, optionally two, calipers groups 31 and 32 are provided to keep in position the movable contact 21.

In particular, when the movable contact 29 arrives in correspondence of the gripping group 31, 32, the shape of the respective gripping portions 50 promotes an insertion of the movable contact 29 in the space between the terminal finger elements 45 of the caliper-like elements 60 of such gripping groups 31, 32. The insertion of the movable contact 29 in the converging portion of the space between these terminal finger elements 45 causes the movement of the terminal finger elements 45 themselves, mutually moving away, each caliper-like element 60 independently moving relative to the others. The successive movement of the movable contact 29 inside the diverging portion of the space between the terminal finger elements 45 causes the return in position of these terminal finger elements 45 approaching each other and surely lock in position the movable contact 29.

On the contrary, when it is desired to move the movable contact 29, a force greater than that of the elastic returning mechanism 47 is exerted, in order to cause an opposite movement of the movable contact 29 passing between the terminal finger elements 45 of the caliper-like elements 60 of the gripping group 31, 32.

Once the movable contact 29 is in position, it creates an electrical path with the terminal contacts 40 or 41, a connecting element 42 or 43 on the opposite side of the switch body 2, a contact bar 35, in contact with such connecting element and which runs peripheric to a terminal contact 34.

The described mechanism generates a pre-calculated pressure on the movable contact 29 that allow the switch to support nominal current rate as well as the short circuit current, without any damage to the device. The pressure on the movable contact 29 is able to guarantee the proper contact resistance for a reduced power dissipation in nominal condition and withstand the electrodynamic strength generated by abnormal current flow in short-circuit condition.

In a disconnector switch, wherein only two terminal contacts 34, 40 are provided, only a movement of the movable contact 29 between an operative position and a disconnecting position is foreseen.

Advantageously, according the present invention, the switch so obtained has a compact structure guaranteed by its internal configuration, thanks to the gripping group 31, 32 comprising the caliper-like elements 60, in turn provided with the terminal finger elements 45 able to ensure a mechanical grip into position of the movable contact 29, in turn providing for the required electrical contact.

Moreover, advantageously, the present solution can be applied both on a disconnector and on other changeover switches.

Still advantageously, the gripping groups and the caliper-like elements of the present invention have a simple but at the same time very efficient operation.

Another advantage is that the gripping groups provide a higher reliability and quick and cheap maintenance.

The present invention is suitable in the most applications wherein a switch in high current is required.

Another advantage of the present invention is that it does not require particular manufacture, that is important for a component clearly intended for mass-production.

Finally, the gripping group and the switch according to the present invention may be used also for switching in high AC current applications.

In the previous lines the directional terms like: "forward", "rearward", "front", "rear", "up", "down", "above", "below", "upward", "downward", "top", "bottom", "side", "vertical", "horizontal", "perpendicular" and "transverse" as well as any other similar directional terms refer just to the device as shown in the drawings and do not relate to a possible use of the same device. Accordingly, these directional terms, as utilized to describe the contactor in its upright vertical position on a horizontal surface have just the meaning to identify a portion of the device with respect to another portion as shown in the figures.

The term "comprising" and its derivatives, as used herein, are intended to be open ended terms that specify the presence of the stated features, elements, components, groups, integers, and/or steps, but do not exclude the presence of other unstated features, elements, components, groups, integers and/or steps. This concept also applies to words of similar meaning, for example, the terms "have", "include" and their derivatives.

Moreover, the terms "member", "section", "portion", "part" and "element" when used in the singular can have the dual meaning of a single part or a plurality of parts.

The invention claimed is:

1. A gripping group for a switch, changeover switch, disconnector or power switch, the power switch being mounted inside an insulated switch body and including at least a movable contact provides an electrical connection, wherein the gripping group is configured to grip the at least a movable contact of the power switch, wherein the gripping group comprises:

a modular structure that includes a plurality of caliper-like elements parallelly mounted on a supporting frame, wherein the plurality of caliper-like elements respective terminal finger elements being angularly movable with respect to each other, mutually towards and moving away in contrast with elastic returning means, wherein each terminal finger element of the caliper-like elements comprises at least two holes, the holes being in proximity of two opposite ends of the terminal finger element, and wherein the gripping group further comprises a pin for each hole of the terminal finger elements of the caliper-like elements.

2. The gripping group of claim 1, wherein each caliper-like element of the gripping group, formed by two of the terminal finger elements, is independently movable relative to others caliper-like elements of the gripping group.

3. The gripping group of claim 1, wherein terminal finger elements of one caliper-like element of the gripping group are independently movable from terminal finger elements of other caliper-like elements of the gripping group.

4. The gripping group of claim 1, wherein the supporting frame further comprises an interconnecting beam, on which the supporting elements are mounted.

5. The gripping group of claim 1, further comprising a bush corresponding to each hole of the terminal finger elements and between the caliper-like elements of the gripping group.

6. The gripping group of claim 1, wherein each of the elastic returning means is alternately located between the caliper-like elements of the gripping group.

7. The gripping group of claim 1, further comprising a locking washer for each pin.

8. The gripping group of claim 1, wherein the terminal finger elements have a rounded pointed tip at one end in correspondence of a gripping portion of the corresponding caliper-like element.

9. The gripping group of claim 1, wherein facing profiles of the terminal finger elements of the caliper-like elements create a converging-diverging space between the terminal finger elements.

10. A power switch for industrial or railways application comprising:

an insulated switch body; and at least one movable contact providing an electrical connection, wherein the at least one movable contact includes at least a gripping group according to claim 1 and configured to grip the least a movable contact.

11. The gripping group of claim 1, wherein the supporting frame includes at least two supporting elements, located at ends of the gripping group, to secure a packed configuration of the caliper-like elements.

12. The gripping group of claim 11, wherein the supporting elements comprise an eyelet for pins corresponding to each hole of the terminal finger elements, at least two eyelet providing a clearance relative to the pins.

* * * * *